US006045482A

United States Patent [19]

Nishar et al.

[11] Patent Number: 6,045,482

[45] Date of Patent: Apr. 4, 2000

[54] SYSTEM FOR CONTROLLING AIR FLOW TO A COOLING SYSTEM OF AN INTERNAL COMBUSTION ENGINE

[75] Inventors: Dipchand V. Nishar, Boston, Mass.; Thomas A. Dollmeyer, Columbus, Ind.

[73] Assignee: Cummins Engine Company, Inc., Columbus, Ind.

[21] Appl. No.: 09/033,559

[22] Filed: Mar. 2, 1998

[51] Int. Cl.[7] ..... F01P 7/02

[52] U.S. Cl. ..... 477/107; 477/97; 477/110; 123/41.13

[58] Field of Search ..... 123/41.12, 41.13; 701/29; 477/97, 98, 107, 110

[56] References Cited

U.S. PATENT DOCUMENTS

| | | | |
|---|---|---|---|
| 4,168,456 | 9/1979 | Isobe | 318/471 |
| 4,313,402 | 2/1982 | Lehnhoff et al. | 123/41.12 |
| 4,325,530 | 4/1982 | Kugler et al. | 123/41.12 |
| 4,425,766 | 1/1984 | Claypole | 62/133 |
| 4,642,770 | 2/1987 | Shirley | 701/29 X |
| 4,651,922 | 3/1987 | Noba | 236/35 |
| 4,977,862 | 12/1990 | Aihara et al. | 123/41.12 |
| 5,224,446 | 7/1993 | Okita et al. | 123/41.12 |
| 5,307,644 | 5/1994 | Cummins et al. | 62/133 |
| 5,359,969 | 11/1994 | Dickrell et al. | 123/41.12 |
| 5,483,927 | 1/1996 | Letang et al. | 123/41.12 |
| 5,505,165 | 4/1996 | Kimoto | 123/41.12 |
| 5,609,125 | 3/1997 | Ninomiya | 123/41.12 |
| 5,612,672 | 3/1997 | Ino et al. | 340/449 |
| 5,623,835 | 4/1997 | Layman et al. | 62/133 |
| 5,647,317 | 7/1997 | Weisman, II et al. | 123/299 |
| 5,847,644 | 12/1998 | Weisman, II et al. | 701/29 X |

OTHER PUBLICATIONS

DDEC III/IV Application and Installation Manual, pp. 14–1–14–13 (Oct. 1998).

*Primary Examiner*—Khoi Q. Ta
*Attorney, Agent, or Firm*—Baker & Daniels

[57] ABSTRACT

A system for controlling air flow to an engine cooling system includes a control computer responsive to a number of engine and/or engine accessory operating conditions, and to various engine operational states to control operation of an engine cooling device. The engine operational states are each a function of at least engine fueling commands and include a "free energy" state corresponding to zero fueling, an "absorbing additional torque" state corresponding to zero fueling and activation of either service brakes or engine brakes, and a "needs additional torque" state corresponding to a rapid positive change in fueling, recent gear shifting to the lower gears of the transmission with fueling above a predefined level or a high rate of change in fueling rate. All other engine operational states are defined as a don't care state. The control computer is operable to control the engine cooling device as a function of the number of engine and/or engine accessory operating conditions and a current engine operating state, wherein examples of the engine and/or engine accessory operating conditions include engine coolant temperature, rate of change of engine coolant temperature, intake manifold air temperature and air conditioner refrigerant pressure. The engine cooling device is preferably a single speed, dual speed or variable speed engine cooling fan.

34 Claims, 7 Drawing Sheets

SYSTEM FOR CONTROLLING AIR FLOW TO A COOLING SYSTEM OF AN INTERNAL COMBUSTION ENGINE

FIELD OF THE INVENTION

The present invention relates generally to systems for controlling engine cooling air flow devices, and more specifically to systems for controlling such devices so as to provide fuel economy and engine performance benefits.

BACKGROUND OF THE INVENTION

Most internal combustion engines in automotive and heavy duty truck applications include an engine cooling system operable to transfer excess heat generated by the engine to ambient. Such systems typically circulate a coolant fluid through the engine and through a radiator situated near the front of the engine. As the vehicle housing the engine is driven, air flows through the porous radiator and transfers excess heat to ambient. In certain vehicle operating conditions, however, the amount of air flowing through the radiator due strictly to vehicle velocity (typically referred to as "RAM air") is insufficient to transfer all of the excess heat from the coolant fluid. Consequently, most engine cooling systems include an additional air flow device situated between the engine and radiator, wherein the air flow device is controllable to provide additional air flow through the radiator. Typical air flow devices are embodied as one or more engine cooling fans which may be controllably driven by the engine itself or via a separate motor.

Known engine cooling fan control systems rely on one or more sensor signals, indicative of various engine/vehicle operating conditions, to control fan operation. For example, U.S. Pat. No. 4,313,402 to Lehnhoff et al. discloses an engine fan control system wherein the average fan speed is controlled to be proportional to engine speed when coolant temperature and engine speed are within specified ranges. U.S. Pat. No. 4,651,966 to Noba discloses a similar engine fan control system including provisions for controlling fan operation as a function of air conditioning load, and wherein two such fans are controlled independently to achieve a desired result. U.S. Pat. No. 5,609,125 to Ninomiya discloses another engine fan control system responsive to coolant fluid temperature and the rate of change of coolant fluid temperature to correspondingly control fan operation. Finally, U.S. Pat. No. 5,359,969 to Dickrell et al. discloses an intermittent engine fan control system wherein fan operation is based on engine speed, coolant temperature, intake manifold air temperature, boost pressure and engine brake status.

While the foregoing systems have been generally successful at controlling engine fan operation as needed based on the various engine/vehicle sensor inputs, it is generally known that engine fan operation is parasitic in that it consumes engine horsepower rather than contributing to it. It has accordingly been recognized that the overall efficiency of the engine can be increased by disengaging engine fan operation when it is not absolutely essential for maintaining engine temperature within a desired range of normal operating temperatures. The aforementioned Dickrell et al. system achieves this goal by basing fan activation events on the various sensor signal values. However, the Dickrell et al. system also suffers from certain drawbacks. For example, the Dickrell et al. system is only operable to deactivate the fan when it is not needed, and while increased fuel economy can accordingly be realized with this system, engine efficiency cannot be fully optimized. What is therefore needed is an engine fan control system that not only increases fuel economy but also optimizes overall engine operational efficiency. Such a system should further preferably achieve other vehicle operational benefits, such as controlling downhill vehicle speed, improving transient response and reducing fan noise during idle and low vehicle speeds.

SUMMARY OF THE INVENTION

The foregoing shortcomings of the prior art are addressed by the present invention. In general, the present invention is directed to determining an engine operational state (EOS), wherein engine fan operation takes into account not only various engine/vehicle sensor information, but furthermore bases fan operation on EOS. In this manner, the engine fan may be freely activated during so-called "free energy" or "absorbed torque" operational states, wherein the parasitic power draw created by fan operation does not affect engine efficiency. During subsequent engine operational states wherein the engine needs additional torque, the need for engine fan operation is accordingly lessened. Thus, the engine fan can essentially be "over-operated" during engine operational states wherein the engine is not requesting torque so that the need for engine fan operation is lessened during subsequent operation wherein the engine is requesting torque.

In accordance with one aspect of the present invention, a system for controlling air flow to a cooling system of an internal combustion engine comprising means for providing air flow to a cooling system of an internal combustion engine, means responsive to a fueling request for producing a fueling signal to a fueling system of the engine, means for determining an operating condition of the engine or accessory thereof and producing a cooling factor signal corresponding thereto, means for determining an engine operational state as a function of the fueling signal, means for determining a flow speed signal as a function of the cooling factor signal and the engine operational state, and means for controlling the means for providing air flow as a function of at least the flow speed signal.

In accordance with another aspect of the present invention, a method of controlling air flow to a cooling system of an internal combustion engine comprises the steps of determining a cooling factor as a function of an engine or engine accessory operating parameter, determining an engine operational state as a function of a fueling command provided to a fueling system of the engine, determining a flow speed as a function of the cooling factor and the engine operational state, and controlling air flow to the cooling system of the internal combustion engine as a function of the flow speed.

In accordance with a further aspect of the present invention, a system for controlling air flow to a cooling system of an internal combustion engine comprises means for providing air flow to a cooling system of an internal combustion engine, means responsive to a fueling request for producing a fueling signal to a fueling system of the engine, means for determining an engine operational state as a function of the fueling signal, means for monitoring changes in the engine operational state, and means for controlling the means for providing air flow as a function of the engine operational state, the means for controlling delaying for at least a predefined time period before altering operation of the means for providing air flow if a rate of change in the engine operational state exceeds a predefined rate.

In accordance with yet another aspect of the present invention, a method of controlling air flow to a cooling system of an internal combustion engine comprises the steps of determining an engine operational state as a function of a fueling command provided to a fueling system of the engine, determining a rate of change of the engine operational state if the engine changes operational states, and controlling air flow to the cooling system of the internal combustion engine flow as a function of the engine operational state by delaying for a predefined time period if the rate of change thereof exceeds a predefined rate and thereafter altering control of the air flow in accordance with a current engine operational state.

One object of the present invention is to provide an improved engine cooling fan control system.

Another object of the present invention is to provide an engine cooling fan control system operable to increase fuel economy and optimize engine operating performance.

These and other objects of the present invention will become more apparent from the following description of the preferred embodiment.

DESCRIPTION OF THE PREFERRED EMBODIMENT

Figure 1:
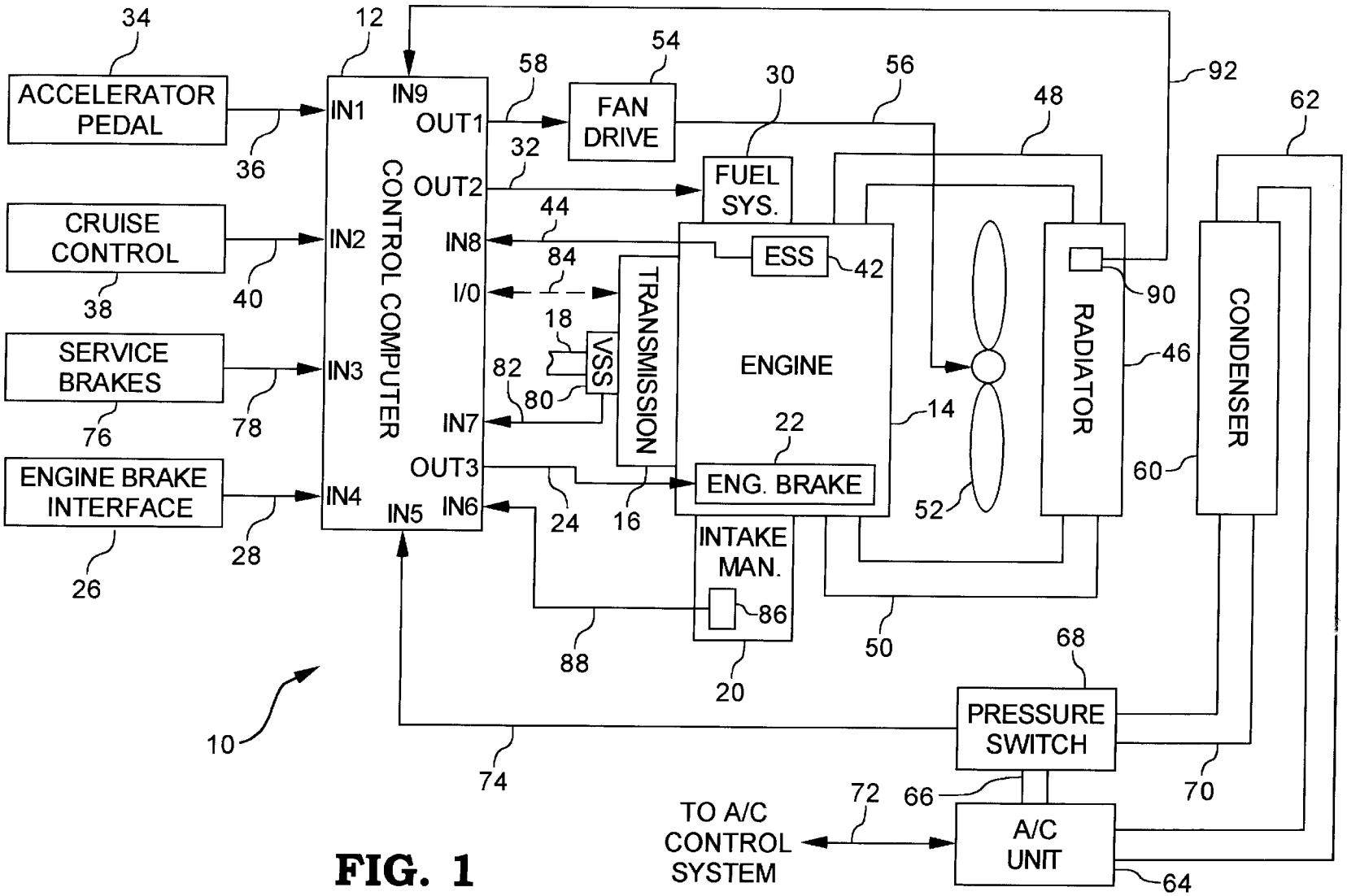
FIG. 1 is a diagrammatic illustration of one preferred embodiment of a system for controlling air flow to a cooling system of an internal combustion engine, in accordance with the present invention.

For the purposes of promoting an understanding of the principles of the invention, reference will now be made to one preferred embodiment illustrated in the drawings and specific language will be used to describe the same. It will nevertheless be understood that no limitation of the scope of the invention is thereby intended, such alterations and further modifications in the illustrated embodiment, and such further applications of the principles of the invention as illustrated therein being contemplated as would normally occur to one skilled in the art to which the invention relates.

Referring now to FIG. 1, one preferred embodiment of a system 10 for controlling air flow to a cooling system of an internal combustion engine is shown. The system 10 includes as its central component a control computer 12. Control computer 12 includes at least a memory portion and a microprocessor portion operable to run software routines resident within memory, and to manage the overall operation of system 10. Preferably, control computer 12 is an electronic control module (ECM) of known construction and commonly used within the automotive and heavy duty truck industry.

The memory portion of control computer 12 may include ROM, RAM, EPROM, EEPROM, FLASH memory and any other type of memory known to those skilled in the art. The memory portion of control computer 12 may be further supplemented by one or more external memory components connected thereto (not shown). Such external memory components may alternatively be used to supplant the memory portion of control computer 12 if control computer 12 lacks such a memory portion, or if the memory portion provides inadequate storage.

Internal combustion engine 14, typically a diesel engine for use with a heavy duty truck, is preferably liquid cooled. To this end, a heat exchanger, preferably a radiator 46, is provided adjacent a front grill area of the vehicle, and is configured so that air may pass therethrough. Radiator 46 is connected to engine 14 via fluid passageways 48 and 50. As is known in the art, a fluid commonly known as engine coolant circulates between engine 14 and radiator 46 via passageways 48 and 50. Heat from engine 14 is transferred to the engine coolant fluid which is, in turn, transferred to the ambient by the radiator 46 as air passes therethrough. In this manner, the operating temperature of liquid cooled engine 14 is maintained within a specified operating range.

A transmission 16 is coupled to the engine 14 as is known in the art, and a tail shaft (or propeller shaft) 18 extends from the transmission 16. As is known in the art, drive torque generated by engine 14 is transferred to transmission 16, wherein any of a number of engageable gear ratios of transmission 16 transfer the torque to tail shaft 18. Tail shaft 18 is driven by transmission 16 in a rotational manner to thereby provide drive force to a drive axle of the vehicle (not shown).

Engine 14 includes an intake manifold 20 connected thereto as is known in the art, wherein manifold 20 draws air into the engine for subsequent mixing with fuel. Engine 14 further preferably includes an engine brake 22 connected to output OUT3 of control computer 12 via signal path 24. An engine brake interface 26, preferably located in the cab area of the vehicle, is connected to input IN4 of control computer via signal path 28. As is known in the art, engine brake 22 is responsive to activation thereof via interface 26 to decrease engine RPM, and may include one or more such engine brake modules connected to control computer via any of a number of signal paths 24.

Engine 14 further includes a fuel system 30 connected thereto which is responsive to fueling signals provided thereto by output OUT1 of control computer 12 via signal path 32. Control computer 12 includes an engine speed governor that is responsive to a fueling command signal to provide such fueling signals. An engine speed sensor 42 associated with engine 14 provides an engine speed feedback signal to input IN8 of control computer 12 via signal path 44, which provides directs the signal to the engine speed governor for closed loop engine speed governor control as is known in the art. Engine speed sensor 42 is preferably a HALL EFFECT sensor operable to sense engine speed and position, although for the purposes of the present invention engine speed sensor 42 may be any known sensor, such as a variable reluctance sensor, operable to sense rotational speed of the engine and provide a signal corresponding thereto to control computer 12.

An accelerator pedal 34 of known construction is connected to input IN1 of control computer 12 via signal path 36 and a known cruise control system 38 is connected to input IN2 of control computer 12 via signal path 40. Accelerator pedal 34 includes a sensor (not shown) that provides a signal on signal path 36 indicative of accelerator pedal deflection, typically in the form of accelerator pedal position or percentage. The accelerator pedal sensor may be a potentiometer having a wiper connected to signal path 36 such that the voltage present on the wiper is indicative of accelerator pedal deflection, although the present invention contemplates that the accelerator pedal sensor may by any known sensor operable to provide a signal to control computer 12 indicative of accelerator pedal deflection. In any event, control computer 12 is responsive to fueling request signals provided by either accelerator pedal 34 or cruise control system 38 to process such signals and provide a corresponding fueling command signal to the engine speed governor as is known in the art. In so doing, control computer 12 typically includes one or more fueling maps that map the fueling request signal provided by accelerator pedal 34 or cruise control system 38, as well as other engine operating parameters, to a desired fueling command that corresponds to a target engine speed. As discussed hereinabove, the engine speed governor is responsive to actual engine speed provided by engine speed sensor 42 to provide for closed loop engine speed control.

Engine 14 further includes an engine cooling device 52 which is provided as a supplemental source of air flow to radiator 46. As is known in the art, cooling device 52 is actuated under certain operating conditions of engine 14 and/or an accessory thereof wherein supplemental air flow is necessary to maintain the temperature of coolant fluid in a desirable operating range. Engine cooling device 52 is illustrated in FIG. 1 as a rotary fan that is electrically connected to a fan drive circuit 54 via signal path 56, comprising one or more signal lines. Fan drive circuit 54 is connected to output OUT1 of control computer 12 via signal path 58 comprising one or more signal lines. Although not illustrated in FIG. 1, it is to be understood that fan 52 is preferably mechanically coupled to engine 14 via a fan clutch that is responsive to control signals provided on signal path 56 to mechanically connect fan 52 to engine 14 as is known in the art. In this manner, fan 52 is driven by the engine 14 under the control of control computer 12. Fan 52 may by a single speed unit ("on" and "off" settings), a dual speed unit ("high", "intermediate" and "off" settings) or a variable speed unit (variable speed between "off" and maximum speed), athough the present invention contemplates using one or more fans 52 having any number of speed settings and/or speed ranges. It should be understood, however, that although engine cooling device 52 is illustrated in FIG. 1 as an electromechanical fan, the present invention contemplates that engine cooling device 52 may be any known electrically actuatable device operable to direct supplemental air flow toward radiator 46.

System 10 further includes an air conditioning system comprising a condenser 60, air conditioning unit 64 electrically connected to an air conditioning control system (not shown) via signal path 72, pressure switch 68 and fluid passageways 62, 66 and 70 as shown in FIG. 1. Pressure switch 68 is electrically connected to input IN5 of control computer 12 via signal path 74. Air conditioning unit 64 includes a refrigerant, typically Freon®, which is preferably pressurized within the air conditioning system as is known in the art. In order to transfer heat from the cab of the vehicle to the external environment, the refrigerant within air conditioning unit 64 is typically circulated through condenser 60 for cooling and back through fluid passageway 62. If vehicle speed is high enough to provide sufficient ram air flow past condenser 60, it may be adequately cooled to prevent the refrigerant pressure from exceeding acceptable pressure limits. However, under certain engine/vehicle operating conditions, such as when the vehicle is stopped with the engine running, ram air flow is typically insufficient to adequately cool condenser 64 and refrigerant pressure may exceed acceptable limits. In this case, the pressure switch 68 is responsive to excessive refrigerant pressure to provide a signal to control computer 12 indicative of excessive refrigerant pressure, to which control computer 12 is responsive to activate engine cooling device 52. In this manner, engine cooling device 52 is used to not only provide supplemental air flow to radiator 46, but also to condenser 60.

The pressure switch 68 is typically a normally closed switch that opens when refrigerant pressure exceeds some predefined range of refrigerant pressures. However, the present invention alternatively contemplates utilizing a pressure sensor positioned within condenser 60, fluid passageways 66 or 70, or within the air conditioning unit 64 itself. Such a pressure sensor may be utilized in a known manner to provide control computer 12 with an indication of acceptable and excessive refrigerant pressure conditions. The present invention further contemplates utilizing a temperature sensor in place of the pressure switch 68 which is operable to sense refrigerant temperature. Using known software methods, such as a lookup table, the temperature of refrigerant provided to condenser 60 could then be correlated to pressure through known conversion techniques. Regardless of the sensing apparatus or technique used, though, the importance of the refrigerant pressure sensor lies in its ability to alert control computer 12 when refrigerant pressure has become excessive.

System 10 further includes a service brake pedal 76 responsive to manual activation thereof to control the service brakes of the vehicle as is known in the art. Preferably, the service brake pedal includes a sensor or switch (not shown) which is connected to input IN3 of control computer 12 to provide control computer 12 with a signal indicative of service brake status.

System 10 further includes a number of sensors for providing control computer 12 with signals indicative of engine and/or accessory operation, some of which are illustrated in FIG. 1. For example, system 10 includes a vehicle speed sensor 80, preferably disposed about tail shaft 18 and electrically connected to input IN7 of control computer 12 via signal path 82. Vehicle speed sensor 80 is preferably a variable reluctance sensor, although the present invention contemplates utilizing other known sensors operable to sense rotational speed of tail shaft 18 and provide a signal corresponding thereto. Alternatively, the present invention contemplates sensing vehicle speed in accordance with any other known techniques, the importance of any such vehicle speed sensor lying in its ability to sense vehicle speed and provide a signal to control computer 12 corresponding thereto. As it relates to the present invention, the vehicle speed signal is used by control computer 12 along with the engine speed signal provided by engine speed sensor 42 to compute the presently engaged gear ratio of transmission 16 as a ratio thereof as is known in the art. Alternatively, transmission 16 may have a dedicated sensing and/or control mechanism associated therewith (not shown) for sensing or otherwise determining presently engaged gear ratio, which is electrically connected to an input/output (I/O) port of control computer 12 via signal path 84, illustrated in FIG. 1 as a dashed line. In any case, presently engaged gear ratio information is used by control computer 12, in accordance with the present invention, to control the operation of the engine cooling device 52 as will be more fully described hereinafter.

As another example of a sensor for providing control computer 12 with a signal indicative of engine and/or accessory operation, air intake manifold 20 includes an intake manifold air temperature sensor 86 electrically connected to input IN6 of control computer 12 via signal path 88. Intake manifold air temperature sensor 86 is operable to sense the temperature of air drawn into the intake manifold 20 and provide a signal to control computer 12 corresponding thereto. As yet another example, the engine cooling system includes an engine coolant temperature sensor 90 electrically connected to input IN9 of control computer 12 via signal path 92. The engine coolant temperature sensor may be connected to the engine 14, disposed within any of the fluid lines 48 or 50, or disposed within the radiator 46 as illustrated in FIG. 1. Regardless of the location of coolant temperature sensor 90, its importance lies in the ability to sense the temperature of engine coolant fluid and provide control computer 12 with a coolant fluid temperature signal corresponding thereto.

In operation, the system 10 executes a software program many times per second to perform an engine cooling device control algorithm in accordance with the present invention. With the aid of the flow charts illustrated in FIGS. 2–8, the operation of system 10 will now be described in detail.

Figure 2:
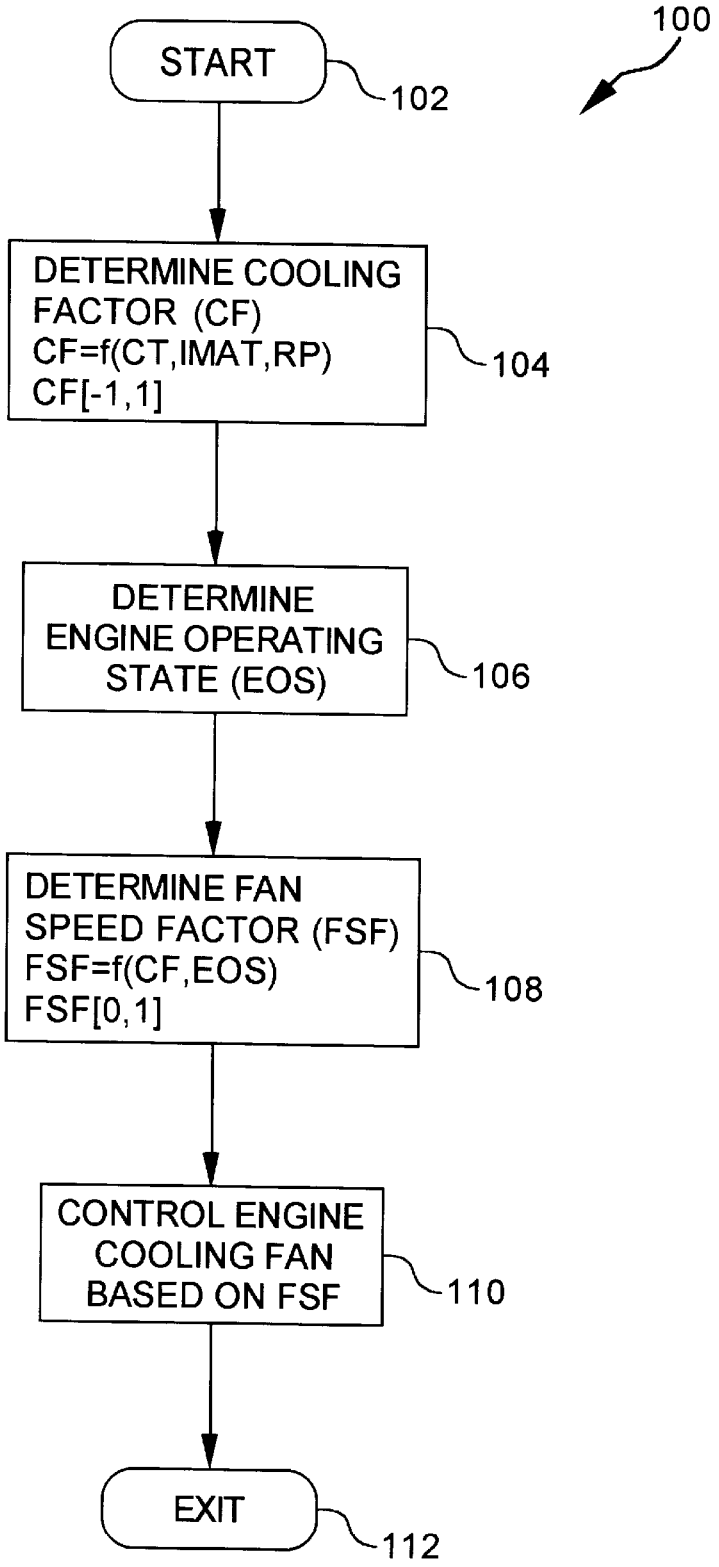
FIG. 2 is a flowchart illustrating one embodiment of a software algorithm for controlling air flow to an engine cooling system such as that illustrated in FIG. 1, in accordance with the present invention.

Referring now to FIG. 2, one preferred embodiment of a software algorithm 100 for controlling air flow to engine cooling system 10, specifically for providing supplemental air flow to radiator 46 and condenser 60 as described hereinabove, is shown. The algorithm begins at step 102 and at step 104, control computer 12 is operable to determine a cooling factor (CF) as a function of at least coolant temperature, and preferably further as a function of refrigerant pressure in the air conditioning system and of intake manifold air temperature. In one embodiment, CF is a continuous function bounded by a minimum value of −1 and by a maximum value of +1. Those skilled in the art will recognize, however, that CF need not be a continuous function and may be defined by any number of equations or by other known techniques such as a look up table. Moreover, the boundaries [−1,1] are arbitrary and any desired boundaries may be used. In any case, one preferred embodiment of a software algorithm for executing step 104 will be described hereinafter with respect to FIG. 3.

Algorithm execution continues from step 104 at step 106 where control computer 12 is operable to determine an engine operating state (EOS). In accordance with an important aspect of the present invention, control computer 12 is operable to control the engine cooling device 52 differently depending upon the current operational state of the engine 14. For example, when the engine 14 is not producing output torque, such as when coasting or braking (i.e. so-called "free energy" and "absorbing additional torque" operational states), control computer 12 is preferably operable to activate the engine cooling device when it might not otherwise do so based on typical sensor information. Under such engine operating conditions, control computer 12 recognizes that the parasitic power drawn by the engine cooling device 46 will not adversely affect engine operation, and in some cases may provide operational benefits such as in providing additional braking power and reducing downhill vehicle speed. With the engine cooling device controlled as just described, operating temperatures of the engine coolant fluid and condenser 60 are accordingly maintained at lower temperatures during free energy and absorbing additional torque engine operating conditions than would otherwise normally occur based on sensor information alone. During subsequent engine operation in a so-called "needs additional torque" operational state (to be defined hereinafter), or other operational state wherein the engine is producing output torque, activation of the engine cooling device 52 may be delayed longer than would otherwise occur if the engine cooling system had not been "pre-cooled" during the free energy or absorbing additional torque engine operational states. Benefits in increased fuel economy, reduction of fan noise, enhanced engine/vehicle operation under certain operating conditions and reduction of power transients are realized. In any case, one preferred embodiment for determining the engine operational state will be described in greater detail hereinafter with respect to FIG. 4.

Algorithm execution continues from step 106 at step 108 where control computer 12 is operable determine a fan speed factor (FSF) as a function of the cooling factor (CF) and engine operational state (EOS). In one embodiment, FSF is preferably at least a piecewise continuous function bounded by a minimum value of 0 and a maximum value of +1. Those skilled in the art will recognize, however, that FSF need not be a piecewise continuous function and may be defined by any number of equations or by other known techniques such as a look up table. Moreover, the boundaries [0,1] are arbitrary and any desired boundaries may be used. In any case, one preferred embodiment of a software algorithm for executing step 108 will be described hereinafter with respect to FIG. 5.

Figure 8:
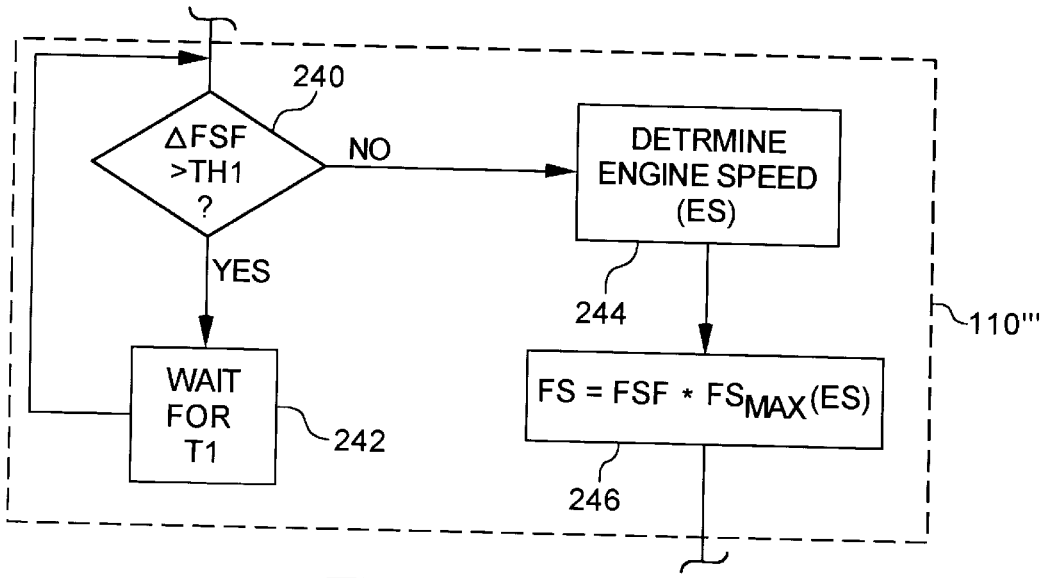
FIG. 8 is a flowchart illustrating one preferred embodiment of a software algorithm for executing the engine cooling fan control step of the flowchart of FIG. 2 according to another alternate embodiment of the engine cooling fan shown in FIG. 1.
Figure 6:
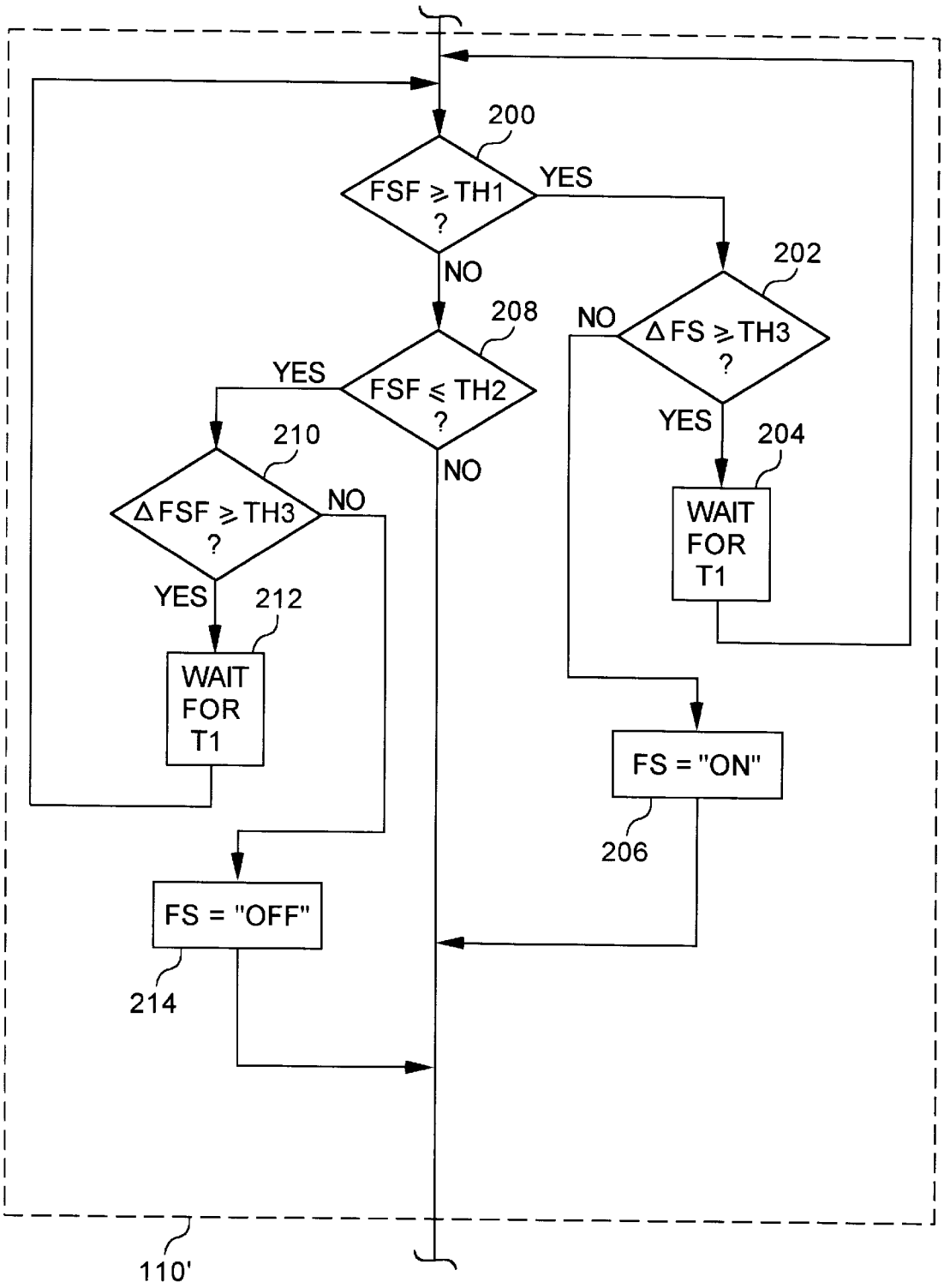
FIG. 6 is a flowchart illustrating one preferred embodiment of a software algorithm for executing the engine cooling fan control step of the flowchart of FIG. 2 according to one embodiment of the engine cooling fan shown in FIG. 1.
Figure 7:
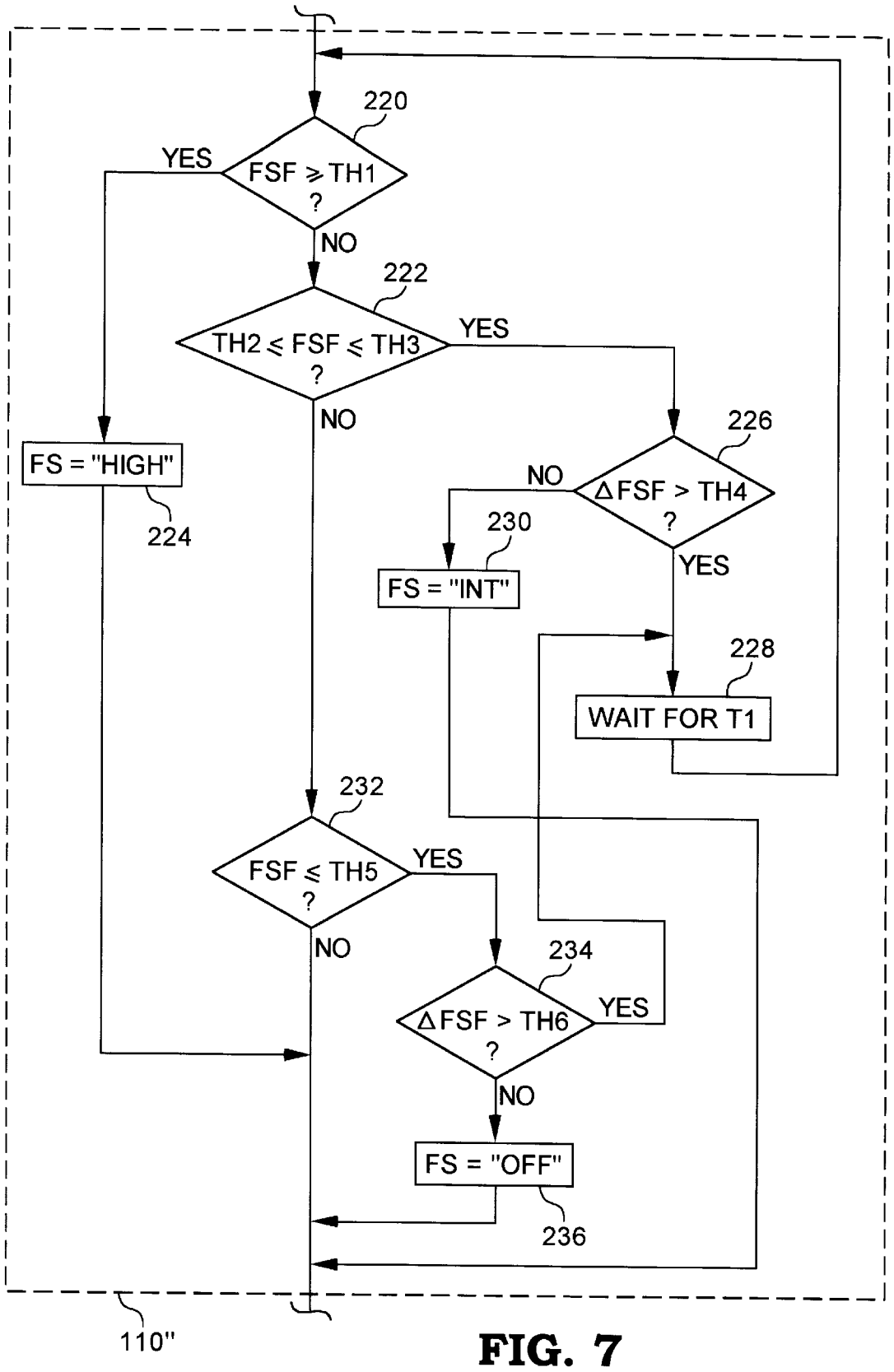
FIG. 7 is a flowchart illustrating one preferred embodiment of a software algorithm for executing the engine cooling fan control step of the flowchart of FIG. 2 according to an alternate embodiment of the engine cooling fan shown in FIG. 1.

Algorithm execution continues from step 108 at step 110 where control computer 12 is operable to control the operation of the engine cooling device 52 based on the fan speed factor FSF. As described hereinabove, the present invention contemplates at least three embodiments of the engine cooling device 52, and FIGS. 6–8 detail cooling device control strategies for each of the three embodiments. Specifically, FIG. 6 details a software algorithm for controlling, as a function of FSF, a single speed engine cooling fan. FIG. 7 details a software algorithm for controlling, as a function of FSF, a dual speed engine cooling fan and FIG. 8 details another software algorithm for controlling, as a function of FSF, a variable speed engine cooling fan. While software algorithms for three specific embodiments of engine cooling device 52 are illustrated in FIGS. 6–8, and will be described in detail hereinafter, it is to be understood that the present invention contemplates utilizing other known engine cooling devices and that it would be a mechanical step for those skilled in the art to adapt the concepts of the present invention to control such devices as a function of FSF. In any event, algorithm execution continues from step 110 at step 12 where algorithm 100 is returned to its calling routine. Alternatively, step 110 may loop back to step 104 for continuous operation of algorithm 100.

Figure 3:
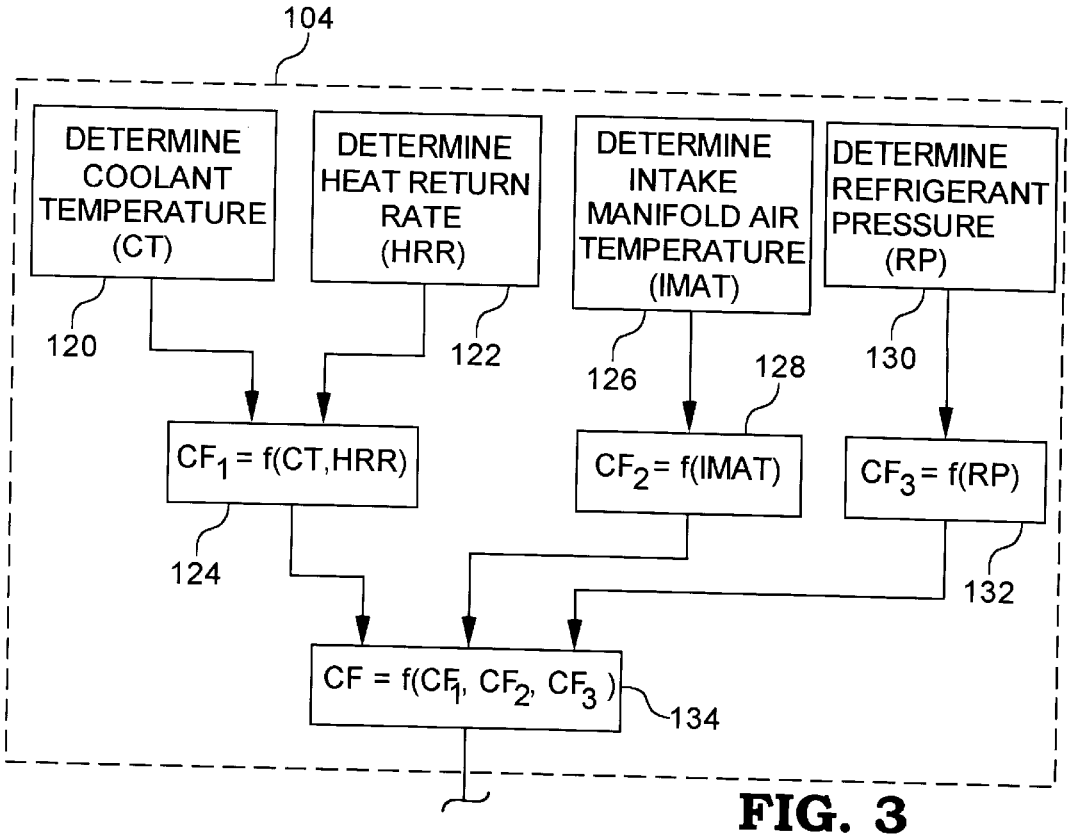
FIG. 3 is a flowchart illustrating one preferred embodiment of a software algorithm for executing the cooling factor determination step of the flowchart shown in FIG. 2.

Referring now to FIG. 3, one preferred embodiment of a software algorithm for executing step 104 of algorithm 100 is shown. At step 120, control computer 12 determines the temperature (CT) of the engine coolant fluid, preferably via the temperature signal provided to input IN9 thereof by the engine coolant temperature sensor 90. At step 122, control computer 12 determines a heat retention rate (HRR) of the engine cooling system, preferably by computing a rate of change of coolant temperature over time. Steps 120 and 122 both lead to step 124 wherein control computer 12 is operable to compute a first cooling factor $CF_1$, preferably as a function of CT and HRR.

In accordance with one embodiment of step 104, the cooling factor $CF_1$ for the CT and HRR combination is preferably based on the following engine cooling desires: (1) when CT is very high, $CF_1$ should correspond to maximum cooling; (2) when CT is moderate and HRR is low, $CF_1$ should correspond to moderate cooling; (3) when CT is moderate and HRR is either non-existent or de minimis, $CF_1$ should correspond little, if any, cooling; and (4) when CT is low, $CF_1$ should correspond to little, if any, cooling. A numerical example of one preferred technique for embodying the four enumerated cooling requirements is shown below:

Let $\mu_{CT}$ denote a membership function for coolant temperature and $\mu_{HRR}$ denote a membership function for heat retention rate. Then, $\mu_{CT}=-1$, for CT≦165° F.

$\mu_{CT}=(1/10)*CT-(175/10)$, for 165° F.≦CT≦175° F.

$\mu_{CT}=0$, for 175° F.≦CT≦185° F.

$\mu_{CT}=(1/20)*CT-(185/20)$, for 185° F.≦CT≦205° F.

$\mu_{CT}=1$, for CT≧205° F., and $\mu_{HRR}=-1$, for ΔCT≦−5° F./sec $\mu_{HRR}=(1/4)*\Delta CT+(1/4)$, for −5° F./sec≦ΔCT≦−1° F./sec $\mu_{HRR}=0$, for −1° F./sec≦ΔCT≦1° F./sec $\mu_{HRR}=(1/2)*\Delta CT-(1/2)$, for 1° F./sec≦ΔCT≦3° F./sec $\mu_{HRR}=1$, for ΔCT≧3° F./sec.

$CF_1$ is then given as:

$$CF_1 = \max(\mu_{CT},\ \mu_{HRR}),\ \text{if } \mu_{CT} \text{ or } \mu_{HRR} = 1$$
$$= \min(\mu_{CT},\ \mu_{HRR}),\ \text{otherwise,}$$

wherein the "max" condition is provided to prevent the engine from overheating due to a slow but steady rise in CT while HRR is small.

At step 126, control computer 12 determines the intake manifold air temperature (IMAT), preferably via the temperature signal provided to input IN6 thereof by the intake manifold air temperature sensor 86. Step 126 leads to step 128 where control computer 12 is operable to compute a second cooling factor $CF_2$ based on IMAT. In accordance with one embodiment of step 104, the cooling factor $CF_2$ for IMAT is preferably based on a desire that the system 10 provide cooling as a monotonic function of temperature when IMAT is high. IF $\mu_{IMAT}$ denotes a membership function for intake manifold air temperature, then, $\mu_{IMAT}=-1$, for IMAT≦165° F.

$\mu_{IMAT}=(1/5)*IMAT-(145/5)$, for 165° F.≦IMAT≦175° F.

$\mu_{IMAT}=0$, for 175° F.≦IMAT≦185° F.

$\mu_{IMAT}=(1/15)*IMAT-(150/5)$, for 185° F.≦IMAT≦205° F.

$\mu_{IMAT}=1$, for IMAT≦205° F.

and $CF_2=\mu_{IMAT}$.

At step 130, control computer 12 determines the status of refrigerant pressure (RP), preferably via the pressure switch signal provided to input IN5 thereof by the pressure switch 68. Step 130 leads to step 132 where control computer 12 is operable to compute a third cooling factor $CF_I$, preferably as a function of either refrigerant pressure or alternatively as a function of the status of the pressure switch 68. In either case, in accordance with one embodiment of step 104, the cooling factor $CF_I$ for refrigerant pressure is preferably based on a desire that the system 10 provide cooling as a monotonic function of RP when RP is high. IF $\mu_{RP}$ denotes a membership function for refrigerant pressure, then $\mu_{RP}=-1$, for RP≦x psi $\mu_{RP}=(1/10)*RP-(x+10/10)$, for x psi≦RP≦(x+20) psi $\mu_{RP}=1$, elsewhere.

If, instead of refrigerant pressure, a refrigerant pressure switch 68 is used, then $\mu_{RP}=1$, for switch=off $\mu_{RP}=1$, for switch=on.

In either case, $CF_3=\mu_{RP}$.

Steps 124, 128 and 132 each lead to step 134 where computer 12 is operable to compute the cooling factor CF, preferably as a function of each of the three cooling factors $CF_1$, $CF_2$, and $CF_3$. In accordance with one preferred embodiment of the present invention, CF is defined according to the equation $CF=\max(CF_1, CF_2, CF_3)$ which ensures that the primary function of cooling the engine is always preserved.

Figure 4:
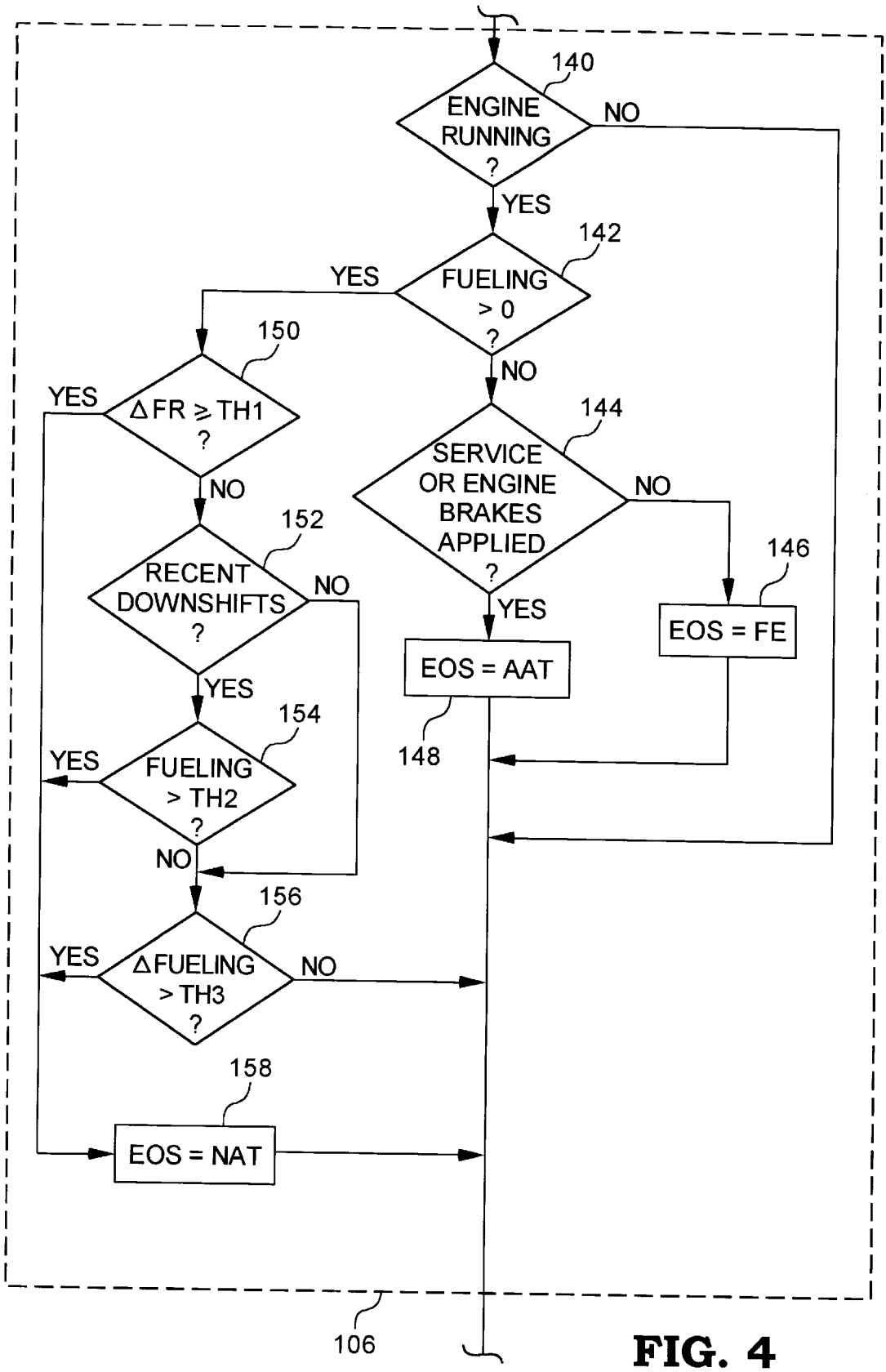
FIG. 4 is a flowchart illustrating one preferred embodiment of a software algorithm for executing the engine operating determination step of the flowchart of FIG. 2.

Referring now to FIG. 4, one preferred embodiment of a software algorithm for executing step 106 of algorithm 100 is shown. The algorithm begins at step 140 where computer 12 determines whether the engine 14 is running. Preferably, computer 12 determines whether the engine is running by monitoring the engine speed signal at input IN8. If the detected engine speed is above an idling threshold, computer 12 determines that the engine is running. If not, algorithm execution advances to step 108 of FIG. 2. If, on the other hand, computer 12 determines at step 140 that the engine is running, algorithm execution continues at step 142 where computer 12 determines whether the commanded fueling is greater than zero for some consecutive number of fueling events (5, for example). Preferably, computer 12 makes this determination by monitoring the fueling signal provided at output OUT1 thereof, although computer 12 may make such a determination by monitoring any of the fueling signals within computer 12 that ultimately determine the fueling signal provided at OUT1. In any event, if the commanded fueling is not greater than zero, algorithm execution continues at step 144 where computer 12 determines whether the service brake 76 or engine brake 22 has been activated. If not, algorithm execution continues at step 146 where computer 12 defines the engine operating state as a "free energy" state (FE), corresponding to zero commanded fueling. If, at step 144, computer 12 determines that either the service brake 76 or engine brake 22 has been activated, algorithm execution continues at step 148 where computer 12 defines the engine operating state as an "absorbing additional torque" state (AAT), corresponding to zero fueling and activation of either the service brake 76 or engine brake 22. Algorithm execution continues from either of steps 146 or 148 to step 108 of FIG. 2.

If, at step 142, computer 12 determines that commanded fueling is greater than zero, algorithm execution continues at step 150 where computer 12 determines whether a rapid, positive change in the fueling request (ΔFR) has occurred. Preferably, computer 12 makes this determination by monitoring the fueling request value due to either accelerator pedal 34 or cruise control system 38, although computer 12 may alternatively make this determination by monitoring the rate of change of the signals on either of signal paths 36 or 40. In any case, computer 12 compares the rate of change in fueling request to a threshold value TH1 and, if ΔFR is less than TH1, algorithm execution continues at step 152. If, at step 150, computer determines that ΔFR is greater than or equal to TH1, algorithm execution continues at step 158. An example of one preferred value for TH1 is 30% per 20 ms, although other threshold values may be used.

At step 152, computer 12 determines whether any recent down shifts to lower gears of transmission 16 have recently occurred (e.g. two downshifts in the past 10 seconds). Preferably, computer 12 makes this determination by monitoring a ratio of engine and vehicle speeds to determine the engaged gear ratio, although such a determination may alternatively be made by monitoring signal path 84 as described hereinabove. If computer 12 determines at step 152 that recent downshifts have occurred, algorithm execution continues at step 154 where commanded fueling is compared to a fueling threshold value TH2. Preferably, computer 12 makes this determination by monitoring the fueling signal provided at output OUT1, although any of the internal fuel command signals may be used to make this determination. In any case, if commanded fueling is greater than the fueling threshold TH2, algorithm execution continues a step 158. If, on the other hand, computer 12 determines at step 154 that commanded fueling is less than the threshold TH2, or if computer 12 determines at step 152 that recent downshifts have not occurred, algorithm execution continues at step 156.

At step 156, computer 12 monitors the rate of change of delivered fuel, preferably by monitoring the fuel signal at output OUT1, and advances to step 158 if this rate of change is greater than a threshold value TH3 (e.g. 100 $mm^3$/sec). If, at step 156, computer 12 determines that the rate of change of delivered fuel is less than TH3, algorithm execution advances to step 108 of FIG. 2. At step 158, control computer 12 defines the engine operating state as a "needs additional torque" state (NAT). Algorithm execution continues from step 158 at step 108 of algorithm 100.

From the foregoing, it should now be apparent that the engine operating state is defined as a free energy state FE if commanded fueling is zero, and is defined as an absorbing additional torque state AAT if commanded fueling is zero and either the service brake 76 or engine brake 22 has been activated. The engine operating state is defined as a needs additional torque state (NAT) if a rapid, positive change in requested fuel has occurred, a recent downshift to lower gears of the transmission has occurred and delivered fuel is greater than a threshold value, or the rate of change of delivered fuel is greater than a threshold value. Any other engine state is defined as a "don't care" engine operating state.

Figure 5:
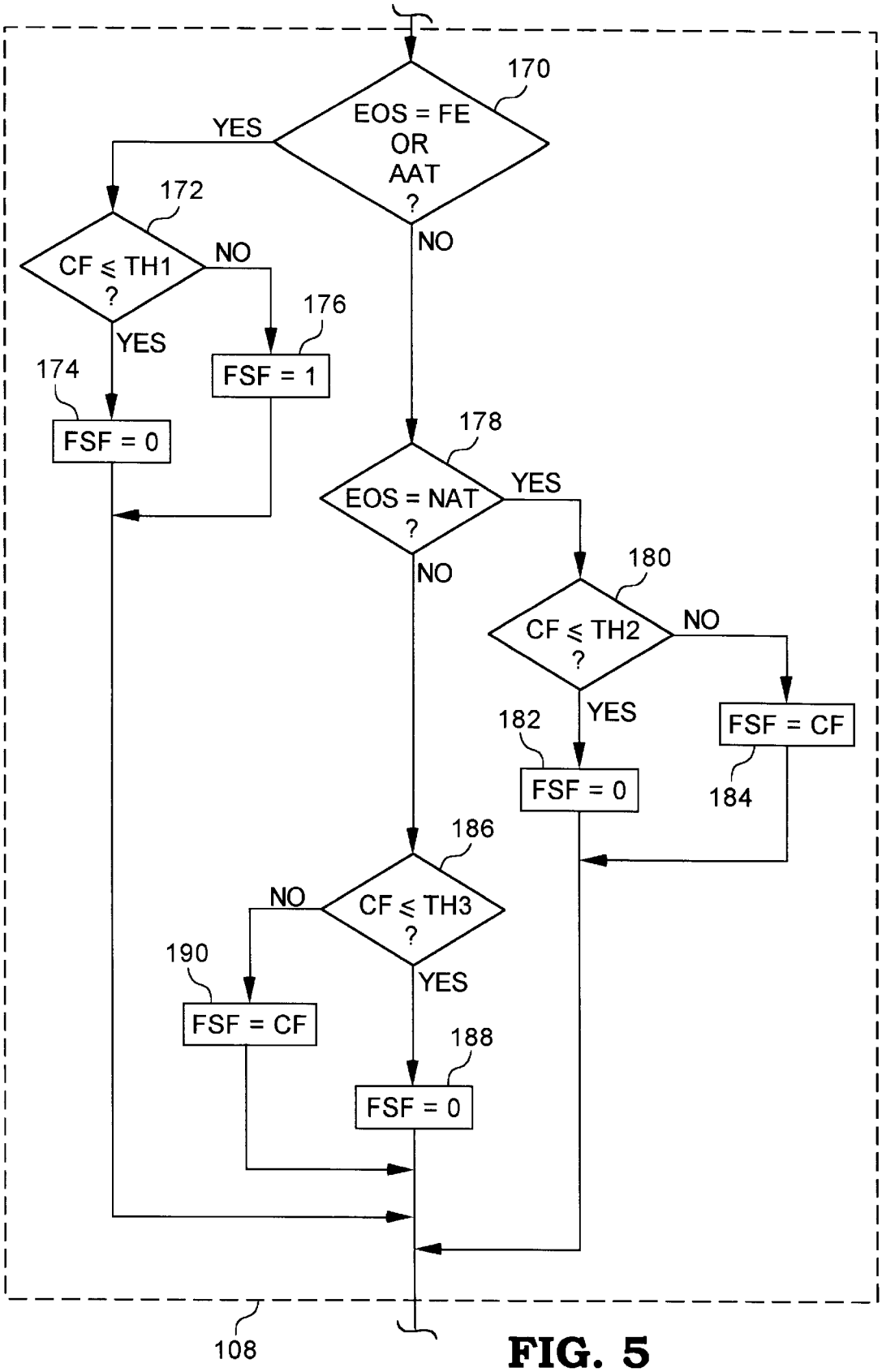
FIG. 5 is a flowchart illustrating one preferred embodiment of a software algorithm for executing the fan speed factor determination step of the flowchart of FIG. 2.

Referring now to FIG. 5, one preferred embodiment of a software algorithm for executing step 108 of algorithm 100 is shown. The algorithm begins at step 170 where computer 12 monitors the engine operating state and proceeds to step 172 if the engine operating state corresponds to either FE or AAT. At step 172, computer 12 compares the cooling factor CF of step 104 with a threshold value TH1 and defines a fan speed factor (FSF) equal to zero at step 174 if CF is less than or equal to TH1. If, on the other hand, CF is greater than TH1, computer defines FSF equal to 1. In one preferred embodiment TH1=−0.5, although other values of TH1 are contemplated. Algorithm execution continues from steps 174 and 176 to step 110 of algorithm 100.

If, at step 170, computer 12 determines that the engine operating state corresponds to either NAT or "don't care", algorithm execution continues at step 178 where computer 12 determines whether the engine operating state corresponds to NAT. If so, algorithm execution continues at step 180 where computer 12 compares the cooling factor CF of step 104 with a threshold value TH2 and defines a fan speed factor (FSF) equal to zero at step 182 if CF is less than or equal to TH2. If, on the other hand, CF is greater than TH2, computer 12 defines FSF equal to CF. In one preferred embodiment TH2=0.5, although other values of TH2 are contemplated. Algorithm execution continues from steps 182 and 184 to step 110 of algorithm 100.

If, at step 178, computer 12 determines that the engine operating state corresponds to "don't care", algorithm execution continues at step 186 where computer 12 compares the cooling factor CF of step 104 with a threshold value TH3 and defines a fan speed factor (FSF) equal to zero at step 188 if CF is less than or equal to TH3. If, on the other hand, CF is greater than TH3, computer 12 defines FSF equal to CF. In one preferred embodiment TH3=0, although other values of TH3 are contemplated. Algorithm execution continues from steps 18 and 190 to step 110 of algorithm 100.

Step 110 of algorithm 100 determines an actual operating speed of engine cooling device 52 based on the fan speed factor FSF. Referring to FIG. 6, one preferred embodiment of a software algorithm for executing step 110 of algorithm 100 is shown, wherein the engine cooling device 52 is a single speed engine cooling fan. The algorithm begins at step 200 where computer 12 compares the fan speed factor FSF with a threshold value TH1. If FSF is greater than or equal to TH1, algorithm execution continues at step 202 where the instantaneous rate of change of FSF (ΔFSF) is compared to a threshold value TH3. If ΔFSF is greater than or equal to TH3, algorithm execution continues at step 204 where computer 12 delays for a time period T1 and then loops back to step 200. If, on the other hand, ΔFSF is less than TH3 at step 202, algorithm execution continues at step 206 where computer 12 defines a fan signal as "on" (corresponding to activation of fan 52). Algorithm execution continues from step 206 at step 112 of algorithm 100.

If, at step 200, computer 12 determines that FSF is less than TH1, algorithm execution continues at step 208 where computer 12 compares the fan speed factor FSF with a threshold value TH2. If FSF is less than or equal to TH2, algorithm execution continues at step 210 where the instantaneous rate of change of FSF (ΔFSF) is compared to the threshold value TH3. If ΔFSF is greater than or equal to TH3, algorithm execution continues at step 212 where computer 12 delays for a time period T1 and then loops back to step 200. If, on the other hand, ΔFSF is less than TH3 at step 210, algorithm execution continues at step 214 where computer 12 defines a fan signal as "off" (corresponding to deactivation of fan 52). Algorithm execution continues from step 214 at step 112 of algorithm 100. Preferably, TH1=0.55, TH2=0.5, TH3=0.5 and T1=5 seconds, although other values may be used.

From the foregoing it should be apparent that the fan 52 is turned on if FSF is greater than 0.55 and is turned off if FSF is less than 0.5. For FSF values between 0.5 and 0.55, the fan 52 stays in its most recent state to prevent cycling of the fan 52 due to rapid changes in CF. If ΔFSF is greater than 0.5 (i.e. a large, positive change), the fan will be held at its most recent state for 5 seconds before being allowed to assume a new state according to the then current FSF value. This prevents cycling of the fan 52 due to rapid changes in engine states.

Referring to FIG. 7, one preferred embodiment of a software algorithm for executing step 110 of algorithm 100 is shown, wherein the engine cooling device 52 is a dual speed engine cooling fan. The algorithm begins at step 220 where computer 12 compares the fan speed factor FSF with a threshold value TH1. If FSF is greater than or equal to TH1, algorithm execution continues at step 224 where computer 12 defines a fan signal as "high" (corresponding to activation of fan 52 at high speed). Algorithm execution continues from step 224 at step 112 of algorithm 100.

If, at step 220, computer 12 determines that FSF is less than TH1, algorithm execution continues at step 222 where computer 12 compares the fan speed factor FSF with threshold values TH2 and TH3. If FSF is between TH2 and TH3, algorithm execution continues at step 226 where the instantaneous rate of change of FSF (ΔFSF) is compared to the threshold value TH4. If ΔFSF is greater than or equal to TH4, algorithm execution continues at step 228 where computer 12 delays for a time period T1 and then loops back to step 220. If, on the other hand, ΔFSF is less than TH4 at step 226, algorithm execution continues at step 230 where computer 12 defines a fan signal as "int" (corresponding to deactivation of fan 52 at an intermediate speed). Algorithm execution continues from step 230 at step 112 of algorithm 100.

If, at step 222, FSF is not between TH2 and TH3, algorithm execution continues at step 232 where computer 12 compares the fan speed factor FSF with a threshold value TH5. If FSF is less than or equal to TH5, algorithm execution continues at step 234 where the instantaneous rate of change of FSF (ΔFSF) is compared to the threshold value TH6. If ΔFSF is greater than or equal to TH6, algorithm execution continues at step 228 where computer 12 delays for a time period T1 and then loops back to step 220. If, on the other hand, ΔFSF is less than TH6 at step 234, algorithm execution continues at step 236 where computer 12 defines a fan signal as "off" (corresponding to deactivation of fan 52). Preferably, TH1=0.75, TH2=0.35, TH3=0.7, TH4=0.35, TH5=0.3, TH6=0.3 and T1=5 seconds, although other values may be used.

From the foregoing it should be apparent that the fan 52 is turned on to high if FSF is greater than 0.75, is turned on to intermediate of FSF is between 0.35 and 0.7, and is turned off if FSF is less than 0.3. For FSF values between 0.7 and 0.75, and between 0.3 and 0.35, the fan 52 stays in its most recent state to prevent cycling of the fan 52 due to rapid changes in CF. If, during intermediate operation, ΔFSF is greater than 0.35, the fan will be held at its most recent state for 5 seconds before being allowed to assume a new state according to the then current FSF value. This prevents cycling of the fan 52 from intermediate to full speed due to rapid changes in engine states. If, when the fan 52 is off, ΔFSF is greater than 0.3, the fan will be held to that state for 5 seconds before being allowed to assume a new state according to the then current FSF value. This prevents cycling of the fan 52 from off to intermediate or full speed due to rapid changes in engine states.

Referring to FIG. 8, one preferred embodiment of a software algorithm for executing step 110 of algorithm 100 is shown, wherein the engine cooling device 52 is a variable speed engine cooling fan. The algorithm begins at step 240 where the instantaneous rate of change of FSF (ΔFSF) is compared to a threshold value TH1. If ΔFSF is greater than or equal to TH1, algorithm execution continues at step 242 where computer 12 delays for a time period T1 and then loops back to step 240. If, on the other hand, ΔFSF is less than TH1 at step 240, algorithm execution continues at step 244 where computer 12 determines engine speed via the engine speed signal provided on signal path 44. Algorithm execution continues therefrom at step 246 where computer defines the fan signal FS as $FSF*FS_{MAX}(ES)$, where $FS_{MAX}(ES)$ corresponds to full fan speed at engine speed ES. Algorithm execution continues from step 246 at step 112 of algorithm 100. Preferably, TH1=0.5 and T1=5 seconds, although other values may be used.

From the foregoing, it should be apparent that computer 12 controls the speed of variable speed fan between zero and full speed according to FSF and the current engine speed. If ΔFSF is greater than 0.5 instantaneously, the fan 52 will be held at its most recent fan speed for 5 seconds before being allowed to assume its new state as determined by the then current FSF to thereby prevent large changes in the fan speed due to rapid changes in engine states.

While the invention has been illustrated and described in detail in the foregoing drawings and description, the same is to be considered as illustrative and not restrictive in character, it being understood that only one preferred embodiment thereof has been shown and described and that all changes and modifications that come within the spirit of the invention are desired to be protected.

What is claimed is:

1. A system, for controlling air flow to a cooling system of an internal combustion engine, comprising:

means for providing air flow to a cooling system of an internal combustion engine;

means responsive to a fueling request for producing a fueling signal to a fueling system of said engine;

means for determining an operating condition of said engine or accessory thereof and producing a cooling factor signal corresponding thereto;

means for determining an engine operational state as a function of said fueling signal;

means for determining a flow speed signal as a function of said cooling factor signal and said engine operational state; and means for controlling said means for providing air flow as a function of at least said flow speed signal.

2. The system of claim 1 wherein said means for providing air flow to a cooling system of an internal combustion engine includes a fan control circuit and a single speed fan, said fan control circuit providing an activation signal to thereby activate said fan and a deactivation signal to thereby deactivate said fan.

3. The system of claim 2 wherein said fan control circuit is operable to provide said activation signal if said flow speed signal is above a first predefined threshold level.

4. The system of claim 3 wherein said fan control circuit is operable to provide said deactivation signal if said flow speed signal is below a second predefined threshold level, wherein said second predefined threshold level is less than said first predefined threshold level.

5. The system of claim 1 wherein said means for providing air flow to a cooling system of an internal combustion engine includes a fan control circuit and a dual speed fan, said fan control circuit providing a first activation signal to thereby activate said fan at a first fan speed, a second activation signal to thereby activate said fan at a second fan speed less than said first fan speed, and a deactivation signal to thereby deactivate said fan.

6. The system of claim 5 wherein said fan control circuit is operable to provide said first activation signal if said flow speed signal is above a first predefined threshold level.

7. The system of claim 6 wherein said fan control circuit is operable to provide said second activation signal if said flow speed signal is above a second predefined threshold level yet below a third predefined threshold level, wherein said third predefined threshold level is less than said first predefined threshold level.

8. The system of claim 7 wherein said fan control circuit is operable to provide said deactivation signal if said flow speed signal is less than a fourth predefined threshold level, wherein said fourth predefined threshold level is less than said second predefined threshold level.

9. The system of claim 1 wherein said means for providing air flow to a cooling system of an internal combustion engine includes a fan control circuit and a variable speed fan, said fan control circuit providing a variable fan speed signal to thereby control said fan at a corresponding variable speed between a deactivated state and a high speed operational state.

10. The system of claim 9 further including means for sensing engine speed and providing an engine speed signal corresponding thereto;

and wherein said fan control circuit is operable to provide said variable speed fan signal as a function of said flow speed signal and said engine speed signal.

11. The system of claim 1 wherein said cooling system includes an engine coolant fluid;

and wherein said means for determining an operating condition of said engine or accessory thereof and producing a cooling factor signal corresponding thereto includes a coolant temperature sensor responsive to engine coolant fluid temperature to provide a coolant temperature signal;

and wherein said cooling factor signal is a function of said coolant temperature signal.

12. The system of claim 11 wherein said means for determining an operating condition of said engine or accessory thereof and producing a cooling factor signal corresponding thereto includes a means responsive to said coolant temperature signal to compute a heat retention value based on a rate of change of said coolant temperature over time;

and wherein said cooling factor signal is a function of said heat retention value.

13. The system of claim 12 wherein said internal combustion engine includes an intake manifold for drawing air into said engine;

and wherein said means for determining an operating condition of said engine or accessory thereof and producing a cooling factor signal corresponding thereto includes an intake manifold sensor associated with said intake manifold and responsive to intake manifold air temperature to provide an intake manifold air temperature signal;

and wherein said cooling factor signal is a function of said intake manifold air temperature signal.

14. The system of claim 13 wherein said internal combustion engine includes an air conditioning system having a refrigerant therein;

and wherein said means for determining an operating condition of said engine or accessory thereof and producing a cooling factor signal corresponding thereto includes a refrigerant pressure sensor associated with said air conditioning system and responsive to refrigerant pressure to provide a refrigerant pressure signal;

and wherein said cooling factor signal is a function of said refrigerant pressure signal.

15. The system of claim 1 wherein said means for determining an engine operational state as a function of said fueling signal is operable to define said engine operational state as a free energy (FE) state if said fueling signal indicates zero fueling for at least a predefined number of fueling events.

16. The system of claim 15 further including a service brake sensor responsive to actuation of a service brake to provide a service brake active signal;

and wherein said engine includes an engine brake responsive to an engine brake actuation activation signal to activate said engine brake;

and wherein said means for determining an engine operational state as a function of said fueling signal is operable to define said engine operational state as an absorbing additional torque (AAT) state if said fueling signal indicates zero fueling for at least a predefined number of fueling events and upon detection of either of said service brake active signal and said engine brake activation signal.

17. The system of claim 1 further including:

a transmission operatively connected to said engine, said transmission having a plurality of selectable gears; and means for determining occurrence of a shift from a presently engaged gear of said transmission to a lower gear thereof;

and wherein said means for determining an engine operational state as a function of said fueling signal is operable to define said engine operational state as a needs additional torque (NAT) state upon detection of any one of a positive change in said fueling signal within a first predefined time period, a recent number of downshifts of said transmission gears within a second predefined time period with said fueling signal above a predefined fueling threshold level, and change in said fueling signal indicating a rate of change of fuel delivery to said engine above a predefined fueling rate threshold level.

18. The system of claim 17 wherein said means for determining a flow speed signal as a function of said cooling factor signal and said engine operational state is operable in either of said FE and AAT engine operational states to provide said flow speed signal corresponding to no air flow if said cooling factor signal is below a first predefined threshold level, and corresponding to maximum air flow if said cooling factor signal is above said first predefined threshold level.

19. The system of claim 18 wherein said means for determining a flow speed signal as a function of said cooling factor signal and said engine operational state is operable in said NAT engine operational state to provide said flow speed signal corresponding to no air flow if said cooling factor signal is below a second predefined threshold level, and corresponding to said cooling factor signal if said cooling factor signal is above said second predefined threshold level.

20. The system of claim 19 wherein said means for determining a flow speed signal as a function of said cooling factor signal and said engine operational state is operable in an operational state other than any of said FE, AAT and NAT engine operational states to provide said flow speed signal corresponding to no air flow if said cooling factor signal is below a third predefined threshold level, and corresponding to said cooling factor signal if said cooling factor signal is above said third predefined threshold level.

21. A method of controlling air flow to a cooling system of an internal combustion engine, comprising the steps of:

determining a cooling factor as a function of an engine or engine accessory operating parameter;

determining an engine operational state as a function of a fueling command provided to a fueling system of the engine;

determining a flow speed as a function of said cooling factor and said engine operational state; and controlling air flow to the cooling system of the internal combustion engine as a function of said flow speed.

22. The method of claim 21 wherein said engine or engine accessory operating state includes a temperature of engine coolant fluid within an engine cooling system.

23. The method of claim 22 wherein said engine or engine accessory operating state includes a rate of change of engine coolant fluid temperature.

24. The method of claim 23 wherein said engine or engine accessory operating state includes a temperature of intake manifold air entering an intake manifold of the engine.

25. The method of claim 24 wherein said engine or engine accessory operating state includes a pressure of refrigerant within an air conditioning system.

26. The system of claim 21 wherein said engine operational state is defined as a free energy (FE) state if said fueling command indicates zero fueling for at least a predefined number of fueling events.

27. The system of claim 26 wherein said engine operational state is defined as an absorbing additional torque (AAT) state if said fueling command indicates zero fueling for at least a predefined number of fueling events and upon detection of either of a command for activation of a service brake and a command for activation of an engine brake.

28. The system of claim 27 wherein said engine operational state is defined as a needs additional torque (NAT) upon detection of any one of a positive change in said fueling command within a first predefined time period, a recent number of downshifts in gears of a transmission within a second predefined time period with said fueling command above a predefined fueling threshold level, and change in said fueling command indicating a rate of change of fuel delivery to the engine above a predefined fueling rate threshold level.

29. The method of claim 28 wherein the flow speed in either of said FE and AAT engine operational states is defined as no air flow if said cooling factor is below a first predefined threshold level, and as maximum air flow if said cooling factor is above said first predefined threshold level.

30. The system of claim 29 wherein the flow speed in said NAT engine operational state is defined as no air flow if said cooling factor is below a second predefined threshold level, and as said cooling factor if said cooling factor is above said second predefined threshold level.

31. The system of claim 30 wherein the flow speed in an operational state other than any of said FE, AAT and NAT engine operational states is defined as no air flow if said cooling factor is below a third predefined threshold level, and as said cooling factor if said cooling factor signal is above said third predefined threshold level.

32. A system for controlling air flow to a cooling system of an internal combustion engine, comprising:

means for providing air flow to a cooling system of an internal combustion engine;

means responsive to a fueling request for producing a fueling signal to a fueling system of said engine;

means for determining an engine operational state as a function of said fueling signal;

means for monitoring changes in said engine operational state; and means for controlling said means for providing air flow as a function of said engine operational state, said means for controlling delaying for at least a predefined time period before altering operation of said means for providing air flow if a rate of change in said engine operational state exceeds a predefined rate.

33. A method of controlling air flow to a cooling system of an internal combustion engine, comprising the steps of:

determining an engine operational state as a function of a fueling command provided to a fueling system of the engine;

determining a rate of change of said engine operational state if said engine changes operational states; and controlling air flow to the cooling system of the internal combustion engine flow as a function of said engine operational state by delaying for a predefined time period if said rate of change thereof exceeds a predefined rate and thereafter altering control of the air flow in accordance with a current engine operational state.

34. A system for controlling air flow to a cooling system of an internal combustion engine, comprising:

a fan for providing air flow to a cooling system of an internal combustion engine;

a fueling system responsive to a fueling signal to provide fuel to said engine;

a first sensor responsive to an engine or engine accessory operating condition for producing a sensor signal corresponding thereto; and a control computer producing said fueling signal and determining an engine operational state as a function thereof, said control computer receiving said sensor signal and determining therefrom a cooling factor, said control computer controlling a speed of said fan as a function of said cooling factor and said engine operational state.

* * * * *

UNITED STATES PATENT AND TRADEMARK OFFICE

CERTIFICATE OF CORRECTION

PATENT NO. : 6,045,482
DATED : April 4, 2000
INVENTOR(S) : Dipchand V. Nishar and Thomas A. Dollmeyer It is certified that error appears in the above-identified patent and that said Letters Patent is hereby corrected as shown below:

Column 17,
Lines 15, 19, 25, 40 and 45, replace "system" with -- method --.

Signed and Sealed this

Fourteenth Day of May, 2002

*Attest:*

*Attesting Officer*

JAMES E. ROGAN
*Director of the United States Patent and Trademark Office*